US010865979B1

(12) United States Patent
Yu et al.

(10) Patent No.: US 10,865,979 B1
(45) Date of Patent: Dec. 15, 2020

(54) LED LAMP MIRROR

(71) Applicant: NINGBO GANPE OPTOELECTRONICS CO., LTD., Ningbo (CN)

(72) Inventors: Xiangjun Yu, Ningbo (CN); Feng Chen, Ningbo (CN)

( * ) Notice: Subject to any disclaimer, the term of this patent is extended or adjusted under 35 U.S.C. 154(b) by 0 days.

(21) Appl. No.: 15/930,391

(22) Filed: May 12, 2020

(30) Foreign Application Priority Data

Nov. 29, 2019 (CN) ..... 2019 2 2103141 U

(51) Int. Cl.

| | |
|---|---|
| ***F21V 33/00*** | (2006.01) |
| ***F21V 3/00*** | (2015.01) |
| ***A47G 1/02*** | (2006.01) |
| ***F21V 7/00*** | (2006.01) |
| *F21W 121/00* | (2006.01) |
| *F21Y 115/10* | (2016.01) |

(52) U.S. Cl.
CPC ..... *F21V 33/004* (2013.01); *A47G 1/02* (2013.01); *F21V 3/00* (2013.01); *F21V 7/0008* (2013.01); *F21W 2121/00* (2013.01); *F21Y 2115/10* (2016.08)

(58) Field of Classification Search
CPC ..... F21V 33/004; F21V 7/0008; A47G 1/02
See application file for complete search history.

(56) References Cited

U.S. PATENT DOCUMENTS

2007/0159316 A1* 7/2007 Mischel, Jr. ..... G02B 27/0101 340/461
2011/0283577 A1* 11/2011 Cornelissen ..... F21V 33/004 40/582
2014/0016353 A1* 1/2014 Chang ..... A45D 42/10 362/612
2016/0341415 A1* 11/2016 Lumaye ..... A45D 42/10
2018/0361008 A1* 12/2018 Munn ..... A61L 9/20

* cited by examiner

*Primary Examiner* — Evan P Dzierzynski
(74) *Attorney, Agent, or Firm* — W&K IP

(57) ABSTRACT

The present disclosure discloses an LED lamp mirror, which comprises a mirror, a diffuser and a mounting frame, and the mirror has a frosted belt proximal its edge; the diffuser and the mounting frame are assembled on the back of the mirror respectively; the mounting frame and the diffuser are separately arranged at the interior and the exterior of the frosted belt; the diffuser and the mounting frame are clamped; the inner side wall of each mounting frame is provided with an LED component; and at least one of the inner top wall and the back of the mirror between the mounting frame and the frosted belt is provided with a reflective component. With a concise structure and less parts involved, the light emitted is high in light intensity, and also uniform and soft.

20 Claims, 7 Drawing Sheets

LED LAMP MIRROR

CROSS-REFERENCE TO RELATED APPLICATIONS

This application claims priority to Chinese Patent Application No. 201922103141.7 with a filing date of Nov. 29, 2019. The content of the aforementioned applications, including any intervening amendments thereto, are incorporated herein by reference.

TECHNICAL FIELD

The present disclosure relates to the technical field of bathroom decoration, in particular to an LED lamp mirror.

BACKGROUND

With regard to a common lamp mirror, an LED lamp is often used as a light-emitting component of which emitted light is directly scattered outward through the frosted portion of a mirror face. A certain illumination effect is provided for the outer environment; however, this mirror has the disadvantages that light is low in brightness and neither uniform nor soft, and its interior structure is complicated, involves more parts and lacks of simplicity.

SUMMARY

The technical problem to be solved by the present disclosure is to provide an LED lamp mirror, which is capable of at least partially resolving the above-mentioned technical problem.

The technical solution adopted to resolve the above-mentioned technical problem by the present disclosure provides an LED lamp mirror, which comprises a mirror, diffuser and mounting frame, and the mirror has a frosted belt proximal its edge; the diffuser and the mounting frame are assembled on the back of the mirror respectively; the mounting frame and the diffuser are separately arranged at the interior and the exterior of the frosted belt; the diffuser and the mounting frame are clamped; the inner side wall of each mounting frame is provided with an LED component; and at least one of the inner top wall and the back of the mirror between the mounting frame and the frosted belt is provided with a reflective component. In some embodiment, the inner bottom wall of the diffuser coupled to the mirror is also provided with a reflective component so as to enhance the light-reflecting effect.

In some embodiment, the mounting frame is a profile frame comprised by an assembly part and a clamping part each having a hollow portion, and the assembly part is assembled on the back of the mirror; and the clamping part is clamped with the diffuser. Therefore, the mounting frame of this structure satisfies two requirements on assembly and clamping, and thus can be reliably, firmly and steadily coupled to the mirror and the diffuser.

Further, end sides of the clamping part and the assembly part are coupled into an integrated structure having an inner top wall and an inner side wall. The mounting frame formed by the assembly part and the clamping part of the above integrated structure not only has high strength but also is light. As the integrated structure formed by coupling the assembly part to the clamping part of this structure is provided with an inner top wall and an inner side wall, proper locations are reserved for the LED component and the reflective component.

In some embodiment, the hollow portion of the assembly part has a square cross section, while the hollow portion of the clamping part is rectangular in cross section. The end side of the clamping part is coupled to the top of the end side of the assembly part. Use of square and rectangular cross sections makes the integrated structure formed become ordered, especially the corner joint is easily spliced. On the inner side wall formed at the lower middle of the end side of the assembly part, the LED component is mounted. The inner top wall formed by the bottom of the clamping part is the place where the reflective component is disposed.

In some embodiment, the hollow portion of the assembly part consists of a first rectangular part integrally coupled to the clamping part, a second rectangular part assembled on the back of the mirror, and a coupling part coupling the first and second rectangular parts, and the coupling part and the side wall part of the second rectangular part constitute the inner side wall where the LED component is mounted; the bottom of the first rectangular part and the bottom of the clamping part constitute the inner top wall where the reflective component is. Therefore, the assembly part of this structure is high in structural strength, hard to deform and wholly ordered.

In some embodiment, the mirror is of a rectangle. At each corner of the mirror, the diffuser is connected by two diffusers in a bevel angle of 45° and the mounting frame is connected by two frames in a bevel angle of 45°. By means of a 45° bevel angle, a seamless connection is realized.

In some embodiment, between two adjacent mounting frames at the corner of the mirror, a first right-angle connecting plate is provided, with its two right-angle portions inserted into the hollow portions of the clamping parts of the mounting frame correspondingly. For one thing, due to the first right-angle connecting plate, two adjacent mounting frames at the corner of the mirror are firmly, reliably coupled, and all mounting frame assembled on the back of the mirror are integrated into a whole so as to bring convenience for suspension of the whole lamp mirror. For the other thing, arrangement of the first right-angle connecting plate makes the mounting frame become leveled.

In some embodiment, the inner bottom wall of the clamping part is provided with support convex ribs for supporting the first right-angle connecting plate. Therefore, on the hollow portion with a longer span, the first right-angle connecting plate is supported by the support convex ribs on the inner bottom wall so as to ensure support power, strength and reliability.

In some embodiment, the inner side wall of the clamping part is provided with support convex ribs for supporting the first right-angle connecting plate. Therefore, on the hollow portion with a shorter span, the first right-angle connecting plate is supported by the support convex ribs on the inner side wall such that the first right-angle connecting plate directly touches the inner top of the hollow portion, and ends of the mounting frame look more leveled.

In some embodiment, between two adjacent mounting frames at the corner of the mirror, a second right-angle connecting plate is provided, with its two right-angle portions inserted into the second rectangular parts of the assembly parts of the mounting frame correspondingly. For one thing, due to the second right-angle connecting plate, two adjacent mounting frames at the corner of the mirror are firmly, reliably coupled, and all mounting frame assembled on the back of the mirror are integrated into a whole so as to bring convenience for suspension of the whole lamp mirror. For the other thing, the second right-angle connecting plate makes the mounting frame become leveled.

In some embodiment, the inner side wall of the second rectangular part is provided with limit convex ribs for limiting the side wall part of the second right-angle connecting plate deviating from the back of the mirror. Therefore, the second right-angle connecting plate is effectively prevented from warping, and thus is flatly limited into the second rectangular part.

In some embodiment, the outer end of the clamping part is equipped with an assembly clamping groove, and the diffuser has a clamping block clamped in the assembly clamping groove to realize clamping between the clamping part and the diffuser.

In some embodiment, the diffuser is of a trough structure, with an opening facing the assembly part. The trough structure comprises a bottom assembled on the back of the mirror, and an exposure part coupled to the external side end of the bottom. The clamping block is mounted at the top of the exposure part. As the opening of the diffuser with the above structure faces the assembly part, light also can give out from the exposure part, thereby further broadening the light illumination range.

In some embodiment, the exposure part with an arc-shaped cross section is rounded in arc and high in overall aesthetic degree.

In some embodiment, the cross section of the diffuser is of an ordered rectangular structure, with a side opening.

In some embodiment, the reflective component may refer to stick-on reflective sheet, which is convenient to stick and easy to operate.

In some embodiment, the LED component is an LED lamp tape convenient to mount and stick.

According to the LED lamp mirror provided by the present disclosure, by merely assembling the diffuser and the mounting frame, a steady frame structure is formed. By assembling the diffuser and the mounting frame on the back of the mirror and disposing a reflective component on at least one of the inner top wall of the mounting frame, and the back of the mirror between the mounting frame and the frosted belt, after the LED component is mounted on the inner side wall of each mounting frame, light, emitted from the LED component, reflected by the reflective component and then passing through the diffuser and the frosted belt of the mirror, brightens a user, in such a case, light gathering effect is obviously enhanced, brightness is high, and light is very soft and uniform.

According to the LED lamp mirror provided by the present disclosure, light emitted from the LED component is reflected and then gives out from both the frosted belt at the front of the mirror and the diffuser, so that both the front of the edge of the mirror and the background (i.e., the radial direction of the mirror) have light to be emitted out. Therefore, the whole light brightness is high, the illumination range is wide, and light is soft and free of dazzling.

BRIEF DESCRIPTION OF THE DRAWINGS

For thorough understanding of the principle and the spirit of the present disclosure, the following embodiments will be described in detail by way of non-limiting examples, which proceeds with reference to the accompanying figures. It should be noted that, features and structures illustrated in the figures may not be the actual ones of the corresponding components or elements, which merely serves explaining the principles of the embodiments of the disclosure.

Figure 1:
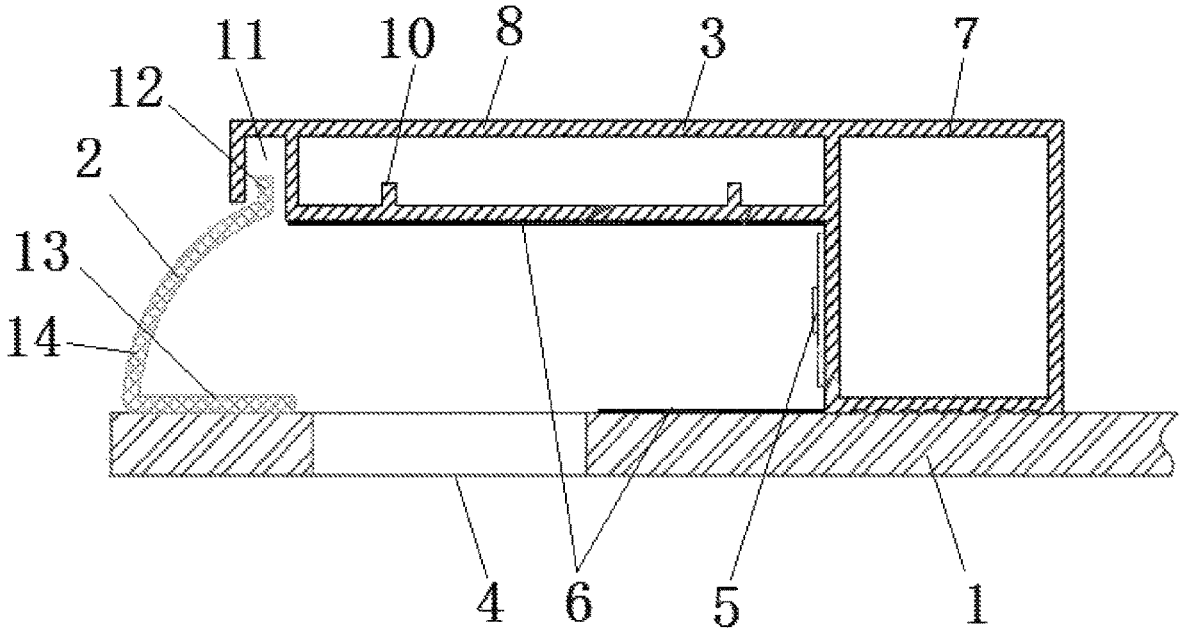
FIG. 1 is a partial sectional view of an LED lamp mirror in Embodiment One of the present disclosure, in which a diffuser has an arc-shaped exposure part.

In figures, 1 mirror; 2 diffuser; 3 mounting frame; 4 frosted belt; 5 LED component; 6 reflective component; 7 assembly part; 8 clamping part; 9 first right-angle connecting plate; 10 support convex rib; 11 assembly clamping groove; 12 clamping block; 13 bottom; 14 exposure part; 15 first rectangular part; 16 second rectangular part; 17 coupling part; 18 second right-angle connecting plate; 19 limit convex rib.

DETAILED DESCRIPTION OF THE DRAWINGS

The specific embodiments of the present disclosure will be explained in detail by way of examples.

It should be understood that, the figures are not necessarily drawn to scale, merely for illustrative purposes. It also should be understood that, same reference numerals are used to denote same or similar elements throughout the accompanying figures.

It should be noted that, the embodiments of the present disclosure are not limited to the illustrated examples. Any modifications and variations made to the described embodiments by those skilled in the art using the principle or spirit of the present disclosure are allowed so as to obtain other embodiments in different forms. Apparently, these embodiments all shall fall into the scope of protection claimed by the present disclosure.

In addition, it should be recognized that, both the referred figures, and shapes and dimensions of all components, and connections between different components in the accompanying figures are illustrative for the embodiments of the present disclosure, but are not intended to limiting the scope of protection of the present disclosure.

Embodiment One

With reference to FIGS. 1, 2, 5 and 6, the present disclosure provides an LED lamp mirror, which comprises a mirror 1, diffuser 2 and mounting frame 3, and the mirror 1 has a frosted belt 4 proximal its edge. The frosted belt 4 encloses into a whole circle along the shape of the mirror 1. The mirror 1 in this embodiment is rectangular and has varied shapes depending on actual requirements, which however cannot be understood as limitation to the extent of protection of claims of the present application. It should be noted that, the frosted belt 4 is formed by sand blasting and disposed along the shape of the mirror 1, and has a certain width for light to emit out.

The diffuser 2 and the mounting frame 3 are assembled on the back of the mirror 1 respectively. In this embodiment, to assemble the diffuser 2 and the mounting frame 3 on the back of the mirror 1, they are stuck on the back of the mirror 1, producing no destructive effect on the mirror 1.

The mounting frame 3 and the diffuser 2 are separately arranged at the interior and the exterior of the frosted belt 4. The diffuser 2 and the mounting frame 3 are clamped. The interior and the exterior of the frosted belt 4 are defined as approaching to/deviating from the inner circle of the frosted belt 4, separately.

The inner side wall of the mounting frame 3 is provided with an LED component 5. At least one of the inner top wall of the mounting frame 3 and the back of the mirror 1 between the mounting frame 3 and the frosted belt 4 is provided with a reflective component 6. However, in this embodiment, both the inner top wall of the mounting frame 3 and the back of the mirror 1 between the mounting frame 3 and the frosted belt 4 are provided with a reflective component 6 respectively. As compared to the structure merely having one reflective component, the light-reflecting effect in this embodiment is better. The LED component 5 may be an LED lamp tape convenient to stick, which is stuck along the inner side wall. The reflective component 6 can be a stick-on reflective sheet that is stuck along the inner top wall of the mounting frame 3 and the back of the mirror 1 between the mounting frame 3 and the frosted belt 4. In such a case, light from the LED lamp tape can be reflected at the inner top wall of the mounting frame 3 and the back of the mirror 1 between the mounting frame 3 and the frosted belt 4. And, it should be noted that, the inner top wall and the inner side wall of the mounting frame 3 refer to those of an interior space formed after the mounting frame, the diffuser and the mirror are assembled (please refer to the inner top wall and the inner side wall of an interior space shown in FIG. 1). Of course, in some other embodiments, the inner bottom wall of the diffuser 2 is also provided with a reflective component 6, thereby effectively improving the light-reflecting effect.

The mounting frame 3 may be an aluminum profile frame comprised by an assembly part 7 and a clamping part 8, and the assembly part 7 is stuck to the back of the mirror 1; and the clamping part 8 is clamped with the diffuser 2. The aluminum profile frame is light and material-saving, and enjoys a strength guarantee. The assembly part 7 and the clamping part 8 each have a hollow portion. The end side of the clamping part 8 and the upper end side of the assembly part 7 are coupled into an integrated structure. The hollow portion of the assembly part 7 has a square-shaped cross section, while the hollow portion of the clamping part 8 is rectangular in cross section, thus having an ordered entirety. Additionally, it should be noted that, the end side of the clamping part refers to its inner side, while the upper end side of the assembly part means the top of its outer side.

Regarding the rectangular mirror 1, at each corner of the mirror 1, the diffuser 2 is connected by two diffusers in a bevel angle of 45° and the mounting frame 3 is connected by two mounting frames in a bevel angle of 45°. But between two adjacent mounting frames 3 at the corner of the mirror 1, a first right-angle connecting plate 9 is provided, with its two right-angle portions inserted into the hollow portions of the clamping parts 8 of the mounting frame 3 correspondingly. Therefore, when in use, the first right-angle connecting plate 9 is fastened on a corresponding clamping part 8 via a fastener so as to couple two adjacent spliced components, i.e., the adjacent two mounting frames 3 are coupled. The diffuser 2 are clamped with the mounting frame 3, so when in assembly, the diffuser and the mounting frame are first assembled into a frame structure by the first right-angle connecting plates, and after assembly, the frame structure can be stuck to the mirror 1, therefore, assembly becomes convenient and rapid, and the whole frame structure is obviously enhanced in connection firmness.

For conveniently suspending the mirror 1 to a corresponding carrier, the top of the assembly part 7 of the mounting frame 3 is provided with a hole for installation with a fastener.

Regarding the interior structure of the clamping part 8, the inner bottom wall of the clamping part 8 is provided with support convex ribs 10 for supporting the first right-angle connecting plate 9. Besides, the support convex ribs 10 enhance the strength of the mounting frame 3 to some extent.

Regarding clamping between the diffuser 2 and the mounting frame 3, the other end of the clamping part 8 is equipped with an assembly clamping groove 11, and the other end refers to the end deviating from the assembly part 7. The diffuser 2 has a clamping block 12 clamped in the assembly clamping groove 11 to realize clamping between the clamping part 8 and the diffuser 2.

The diffuser 2 is of a trough structure with an opening facing the assembly part 7. The trough structure comprises a bottom 13 assembled on the back of the mirror 1, and an exposure part 14 coupled to the external side end of the bottom 13. The clamping block 12 is mounted at the top of the exposure part 14 (see FIG. 1).

The cross section of the exposure part 14 of the diffuser 2 may be arc-shaped (see FIG. 1).

Figure 2:
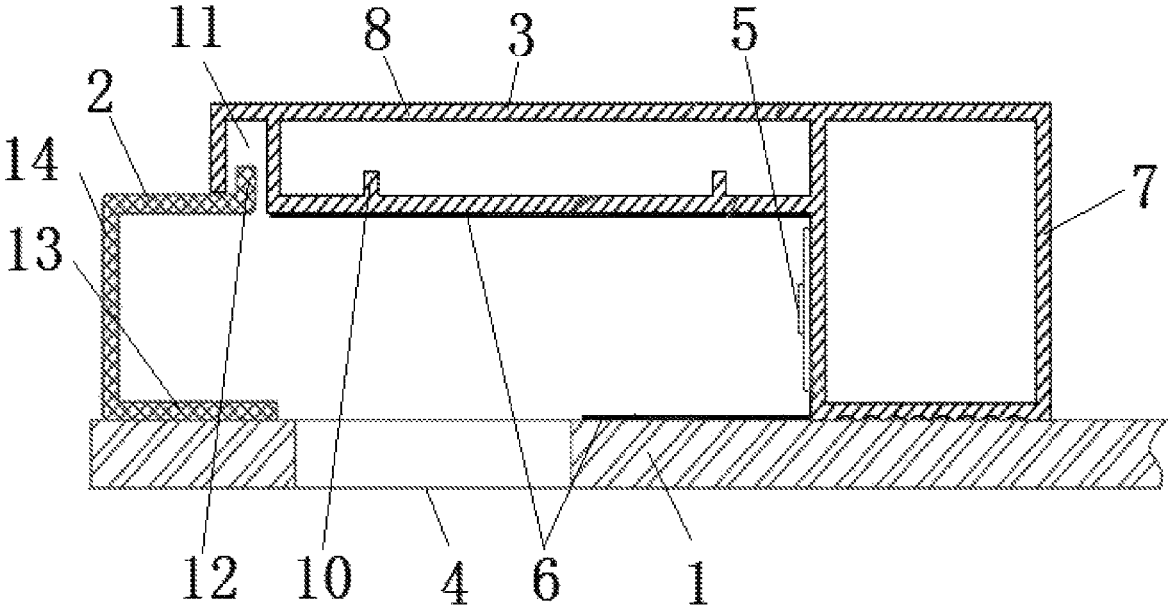
FIG. 2 is a partial sectional view of the LED lamp mirror in Embodiment One of the present disclosure, in which the cross section of the diffuser is of a rectangular structure with a side opening.

The cross section of the exposure part 14 of the diffuser 2 may take on a rectangle formed by combining with the bottom 13 and provided with a side opening (see FIG. 2). The specific cross section shape will be set as required, which has no effect on the extent of protection of the claims.

The diffuser 2 is made of a material with light-admitting property, such as a PC cover.

Embodiment Two

Compared to Embodiment One, the clamping part 8 and the assembly part 7 in this embodiment have different structure and shape. With reference to FIGS. 3, 4, 5 and 7, in this embodiment, an LED lamp mirror comprises a mirror 1, diffuser 2 and mounting frame 3, and the mirror 1 has a frosted belt 4 proximal its edge.

The diffuser 2 and the mounting frame 3 are assembled on the back of the mirror 1 respectively. The mounting frame 3 and the diffuser 2 are separately arranged at the interior and the exterior of the frosted belt 4. The diffuser 2 and the mounting frame 3 are clamped.

The inner side wall of the mounting frame 3 is provided with an LED component 5. At least one of the inner top wall of the mounting frame 3 and the back of the mirror 1 between the mounting frame 3 and the frosted belt 4 is provided with a reflective component 6. However, in this embodiment, both the inner top wall of the mounting frame 3 and the back of the mirror 1 between the mounting frame 3 and the frosted region 4 are provided with a reflective component 6 respectively. To enhance the light-reflecting effect, the inner bottom wall of the diffuser 2 is also provided with a reflective component 6.

The mounting frame 3 is a profile frame comprised by an assembly part 7 and a clamping part 8 each having a hollow portion, and the assembly part 7 is assembled on the back of the mirror 1; and the clamping part 8 is clamped with the diffuser 2. End sides of the clamping part 8 and the assembly part 7 are coupled into an integrated structure having an inner top wall and an inner side wall.

The mirror 1 is of a rectangle. At each corner of the mirror 1, the diffuser 2 is connected by two diffusers 2 in a bevel angle of 45° and the mounting frame 3 is connected by two frames 3 in a bevel angle of 45°.

The hollow portion of the assembly part 7 consists of a first rectangular part 15 integrally coupled with the clamping part 8, a second rectangular part 16 assembled on the back of the mirror 1, and a coupling part 17 coupling the first and second rectangular parts 15, 16, and the coupling part 17 and the side wall part of the second rectangular part 16 constitute the inner side wall where the LED component 5 is mounted; the bottom of the first rectangular part 15 and the bottom of the clamping part 8 constitute the inner top wall where the reflective component 6 is mounted. The hollow portion of the clamping part 8 is rectangular.

Between two adjacent mounting frames 3 at the corner of the mirror 1, a first right-angle connecting plate 9 is provided, with its two right-angle portions inserted into the hollow portions of the clamping parts 8 of the mounting frame 3 correspondingly.

The inner side wall of the clamping part 8 is provided with support convex ribs 10 for supporting the first right-angle connecting plate 9.

Between two adjacent mounting frames 3 at the corner of the mirror 1, a second right-angle connecting plate 18 is provided, with its two right-angle portions inserted into the second rectangular parts 16 of the assembly parts 7 of the mounting frame 3 correspondingly.

The inner side wall of the second rectangular part 16 is provided with limit convex ribs 19 for limiting the side wall part of the second right-angle connecting plate 18 deviating from the back of the mirror 1.

The outer end of the clamping part 8 is equipped with an assembly clamping groove 11, and the diffuser 2 has a clamping block 12 clamped in the assembly clamping groove 11 to realize clamping between the clamping part 8 and the diffuser 2.

The diffuser 2 is of a trough structure with an opening facing the assembly part 7. The trough structure comprises a bottom 13 assembled on the back of the mirror 1, and an exposure part 14 coupled to the external side end of the bottom 13. The clamping block 12 is mounted at the top of the exposure part 14. In this embodiment, the exposure part 14 has an arc-shaped cross section (see FIG. 3).

Figure 4:
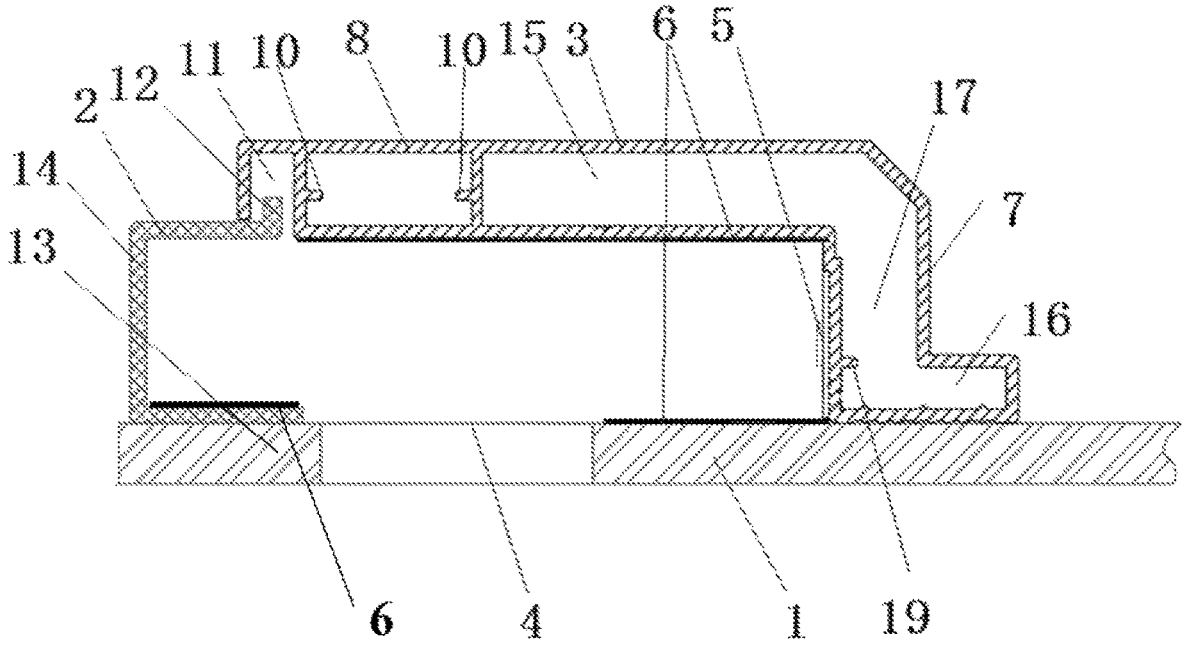
FIG. 4 is a partial sectional view of the LED lamp mirror in Embodiment Two of the present disclosure, in which the cross section of the diffuser is of a rectangular structure with a side opening.
Figure 5:
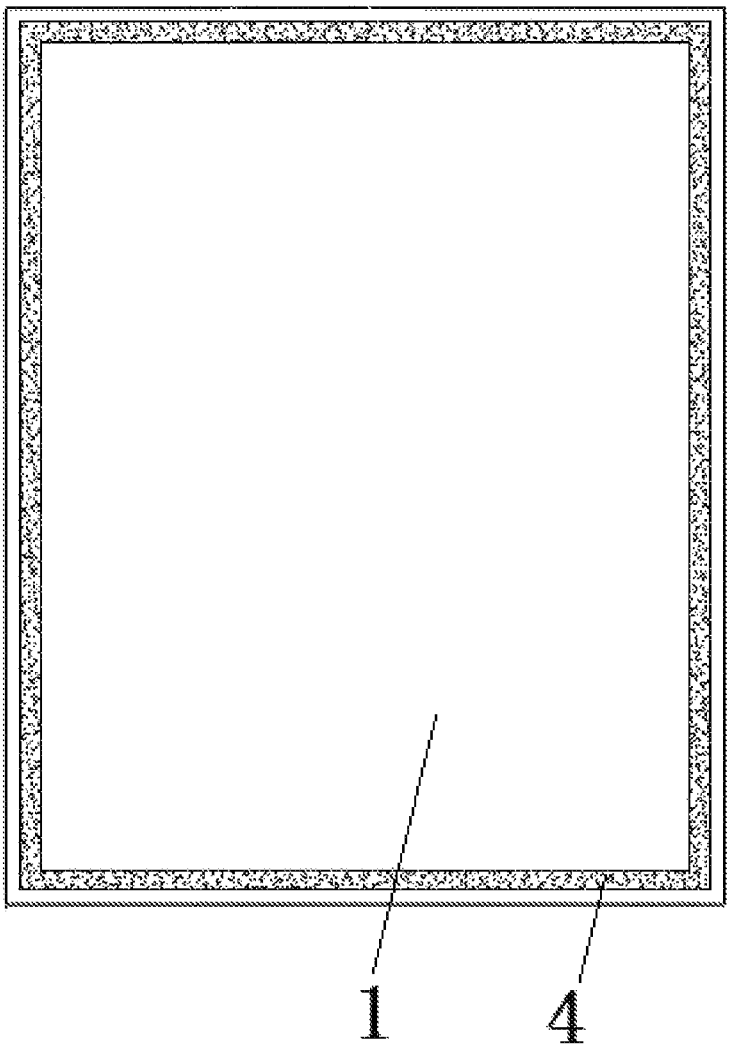
FIG. 5 is a schematic diagram showing the front of the LED lamp mirror in each embodiment.
Figure 6:
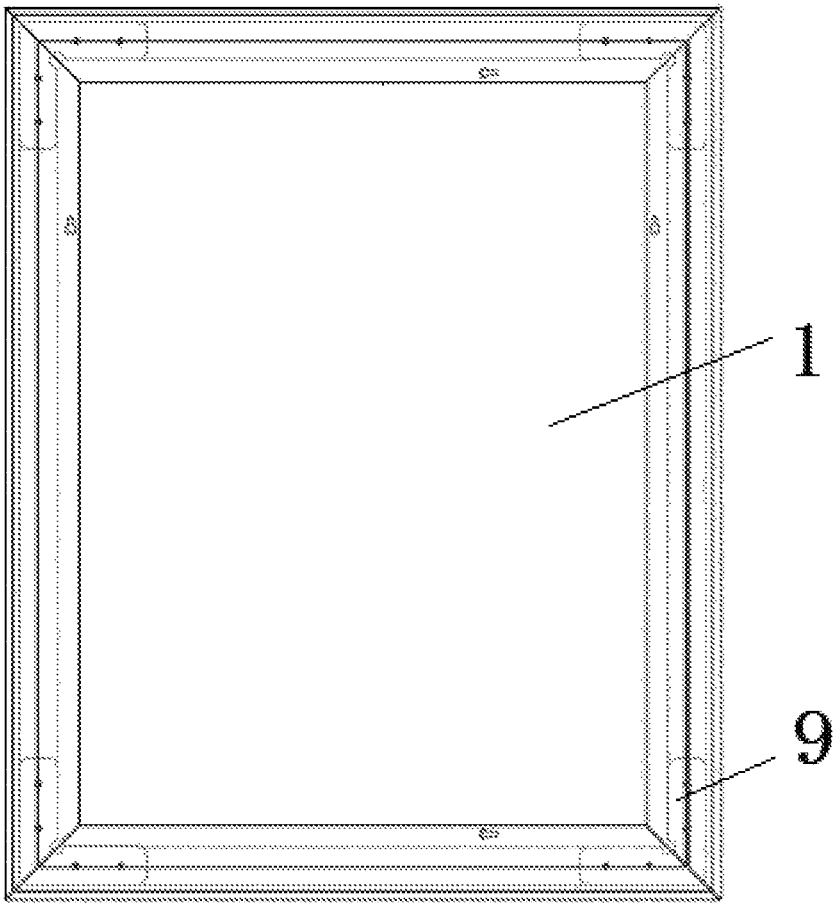
FIG. 6 is a schematic diagram showing the back of the LED lamp mirror in embodiment One.
Figure 7:
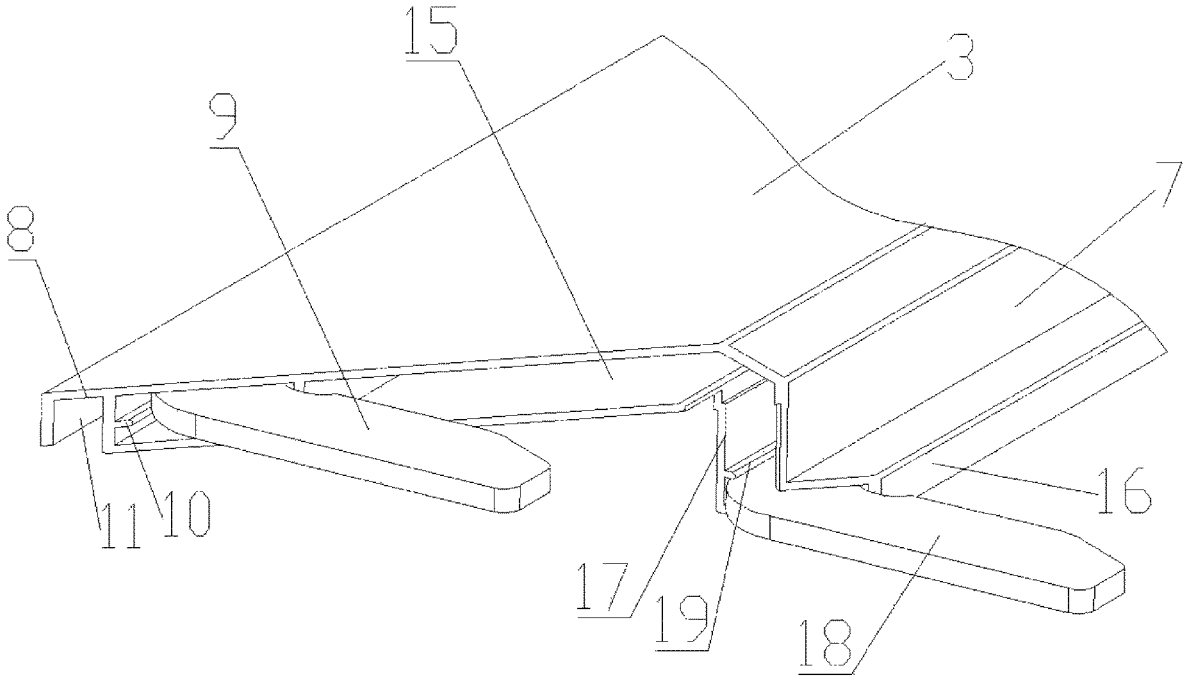
FIG. 7 is a schematically structural diagram of mounting frame at the corner in Embodiment Two.

The cross section of the diffuser 2 may be of a rectangular structure, with a side opening (see FIG. 4).

The reflective component can be a stick-on reflective sheet and the LED component is an LED lamp tape.

According to the LED lamp mirror provided by the present disclosure, after light emits out from the LED lamp tape on the inner side wall of the assembly part 7, a portion of light is reflected by the stick-on reflective sheet on the top and bottom, and then non-reflected light and reflected light pass through the diffuser 2 and the frosted belt 4 of the mirror 1 to brighten a user. Furthermore, a light gathering effect is produced after reflection, and in addition to the light-admitting property of the diffuser 2, the emitted light is high in brightness, more uniform, soft and free of dazzling, and the illumination range is wide.

Figure 3:
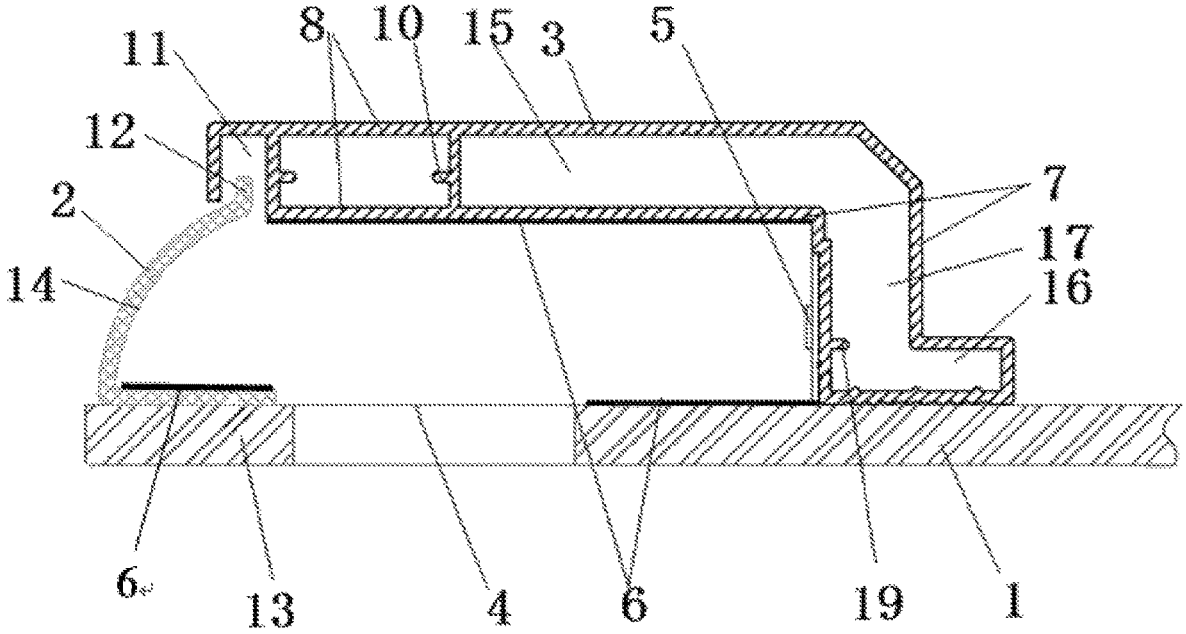
FIG. 3 is a partial sectional view of the LED lamp mirror in Embodiment Two of the present disclosure, in which the diffuser has an arc-shaped exposure part.

The interior, exterior, inner top wall, inner side wall and other orientations possibly involved in the foregoing contents are illustrated in FIGS. 1 and 3.

The above has given detailed description about the embodiments of the present disclosure in conjunction with the accompanying figures. However, it should be noted that, the above embodiments are merely illustrative, rather than restrictive, to the present disclosure, and those skilled in the art are allowed to work out a lot of alternative embodiments as long as not departing from the scope defined by the attached claims. In claims, the term "include" is not intended to exclude other elements or steps except for those exemplified therein. The term "a' or "one" used before an element does not mean to exclude the possibly existing more elements either. Even if some features are disclosed in mutually different dependent claims, it does not mean denying advantageous use of their combinations.

We claim:

1. An LED lamp mirror, comprising a mirror, a diffuser and a mounting frame, and the mirror has a frosted belt proximal its edge, wherein the diffuser and the mounting frame are assembled on the back of the mirror respectively; the mounting frame and the diffuser are separately arranged at the interior and the exterior of the frosted belt; the diffuser and the mounting frame are clamped; the inner side wall of each mounting frame is provided with an LED component; and at least one of the inner top wall and the back of the mirror between the mounting frame and the frosted belt is provided with a reflective component.

2. The LED lamp mirror of claim 1, wherein the mounting frame is a profile frame comprised by an assembly part and a clamping part each having a hollow portion, and the assembly part is assembled on the back of the mirror; and the clamping part is clamped with the diffuser.

3. The LED lamp mirror of claim 2, wherein the end sides of the clamping part and the assembly part are coupled into an integrated structure having an inner top wall and an inner side wall.

4. The LED lamp mirror of claim 3, wherein the mirror is of a rectangle; and at each corner of the mirror, the diffuser is connected by two diffusers in a bevel angle of 45° and the mounting frame is connected by two mounting frames in a bevel angle of 45°.

5. The LED lamp mirror of claim 4, wherein the hollow portion of the assembly part has a square cross section, and the hollow portion of the clamping part is rectangular in cross section, and the end side of the clamping part is coupled to the top of the end side of the assembly part.

6. The LED lamp mirror of claim 5, wherein between two adjacent mounting frames at the corner of the mirror, a first right-angle connecting plate is provided, with its two right-angle portions inserted into the hollow portions of the clamping parts of the mounting frame correspondingly.

7. The LED lamp mirror of claim 6, wherein the inner bottom wall of the clamping part is provided with support convex ribs for supporting the first right-angle connecting plate.

8. The LED lamp mirror of claim 6, wherein the inner side wall of the clamping part is provided with support convex ribs for supporting the first right-angle connecting plate.

9. The LED lamp mirror of claim 4, wherein the hollow portion of the assembly part consists of a first rectangular part integrally coupled to the clamping part, a second rectangular part assembled on the back of the mirror, and a coupling part coupling the first and second rectangular parts, and the coupling part and the side wall part of the second rectangular part constitute the inner side wall where the LED component is mounted; the bottom of the first rectangular part and the bottom of the clamping part forms the inner top wall for arranging the reflective component.

10. The LED lamp mirror of claim 9, wherein between two adjacent mounting frames at the corner of the mirror, a second right-angle connecting plate is provided, with its two right-angle portions inserted into the second rectangular parts of the assembly parts of the mounting frame correspondingly.

11. The LED lamp mirror of claim 10, wherein the inner side wall of the second rectangular part is provided with limit convex ribs for limiting the side wall part of the second right-angle connecting plate deviating from the back of the mirror.

12. The LED lamp mirror of claim 9, wherein between two adjacent mounting frames at the corner of the mirror, a first right-angle connecting plate is provided, with its two right-angle portions inserted into the hollow portions of the clamping parts of the mounting frame correspondingly.

13. The LED lamp mirror of claim 12, wherein the inner bottom wall of the clamping part is provided with support convex ribs for supporting the first right-angle connecting plate.

14. The LED lamp mirror of claim 2, wherein the outer end of the clamping part is equipped with an assembly clamping groove, and the diffuser has a clamping block clamped in the assembly clamping groove to realize clamping between the clamping part and the diffuser.

15. The LED lamp mirror of claim 14, wherein the diffuser is of a trough structure, with an opening facing the assembly part, and the trough structure comprises a bottom assembled on the back of the mirror, and an exposure part coupled to the external side end of the bottom; the clamping block is mounted at the top of the exposure part.

16. The LED lamp mirror of claim 15, wherein the cross section of the exposure part is arc-shaped.

17. The LED lamp mirror of claim 15, wherein the cross section of the diffuser is of an ordered rectangular structure, with a side opening.

18. The LED lamp mirror of claim 1, wherein the reflective component is a stick-on reflective sheet.

19. The LED lamp mirror of claim 1, wherein the LED component is an LED lamp tape.

20. The LED lamp mirror of claim 1, wherein the inner bottom wall of the connection between the diffuser and the mirror is also provided with a reflective component.

* * * * *